US008277265B1

(12) United States Patent
Sykes et al.

(10) Patent No.: US 8,277,265 B1
(45) Date of Patent: Oct. 2, 2012

(54) ELECTRICAL CONNECTOR FOR MATING IN TWO DIRECTIONS

(75) Inventors: Michael T. Sykes, Mechanicsburg, PA (US); Nicholas L. Evans, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/164,576

(22) Filed: Jun. 20, 2011

(51) Int. Cl.
*H01R 4/48* (2006.01)

(52) U.S. Cl. ..... 439/862; 439/947

(58) Field of Classification Search ..... 439/862, 439/857, 660, 947
See application file for complete search history.

(56) References Cited

U.S. PATENT DOCUMENTS

| | | | | |
|---|---|---|---|---|
| 5,156,553 | A * | 10/1992 | Katsumata et al. | 439/62 |
| 5,158,471 | A * | 10/1992 | Fedder et al. | 439/80 |
| 5,316,486 | A * | 5/1994 | Tanaka et al. | 439/62 |
| 5,431,576 | A | 7/1995 | Matthews | |
| 5,713,764 | A * | 2/1998 | Brunker et al. | 439/636 |
| 6,186,843 | B1 * | 2/2001 | Chen et al. | 439/885 |
| 6,210,240 | B1 | 4/2001 | Comerci et al. | |
| 6,255,588 | B1 * | 7/2001 | Shepherd | 174/72 B |
| 6,299,492 | B1 | 10/2001 | Pierini et al. | |
| 6,394,818 | B1 * | 5/2002 | Smalley, Jr. | 439/79 |
| 6,402,525 | B2 * | 6/2002 | Gugliotti et al. | 439/65 |
| 701,451 | A1 | 3/2006 | Yang | |
| 7,011,548 | B2 | 3/2006 | Bogiel et al. | |
| 7,104,812 | B1 * | 9/2006 | Bogiel et al. | 439/79 |
| 7,744,376 | B2 * | 6/2010 | Vrenna et al. | 439/60 |

* cited by examiner

*Primary Examiner* — Tulsidas C Patel
*Assistant Examiner* — Phuongchi Nguyen

(57) ABSTRACT

An electrical connector is provided for mating with a mating connector having a mating contact. The electrical connector includes a housing having a receptacle that is configured to receive the mating contact therein from an insertion direction. An electrical contact is held within the receptacle of the housing. The electrical contact includes opposing arms and a contact finger that extends from one of the arms to the other arm. The contact finger includes a mating interface configured to engage the mating contact when the mating contact is received within the receptacle to electrically connect the electrical contact to the mating contact. The contact finger includes a segment having a length that extends at an angle relative to the insertion direction. The segment includes at least a portion of the mating interface. The electrical contact is configured to electrically connect to the mating contact when the mating contact is inserted into the receptacle of the housing in the insertion direction.

20 Claims, 6 Drawing Sheets

ELECTRICAL CONNECTOR FOR MATING IN TWO DIRECTIONS

BACKGROUND OF THE INVENTION

The subject matter herein relates generally to electrical power connectors.

Electrical power connectors are used for a wide variety of electrical power applications, such as power supply systems, power distribution systems, bus bars, backplanes, and/or the like. Within such applications, a power connector is sometimes mounted to a circuit board for transmitting electrical power to and/or from the circuit board. One example of a power connector includes a receptacle that is configured to receive a blade contact of a mating connector that mates with the power connector. Such a power connector may be configured to receive the blade contact within the receptacle from either of two different insertion directions. For example, some power connectors are configured to receive the blade contact from an insertion direction that extends perpendicular to the circuit board, which is sometimes referred to as a "vertical" insertion direction. Power connectors that receive the blade contact in a vertical insertion direction are sometimes referred to as "vertical" connectors. Other power connectors are configured to receive the blade contact from an insertion direction that extends parallel to the circuit board, which is sometimes referred to as a "side-entry" insertion direction. Power connectors that receive the blade contact in a side-entry insertion direction are sometimes referred to as "side-entry" connectors.

The electrical contacts of vertical power connectors have different geometries than the electrical contacts of side-entry power connectors. More specifically, the electrical contacts of vertical power connectors have a geometry that establishes a reliable electrical connection with a blade contact received in a vertical insertion direction. In contrast, the electrical contacts of side-entry power connectors have a different geometry that establishes a reliable electrical connection with a blade contact received in a side-entry insertion direction. In other words, an electrical contact designed for use within a vertical power connector cannot be used within a side-entry power connector, and vice versa. Accordingly, a manufacturer, supplier, and/or the like of both vertical and side-entry power connectors must fabricate and/or stock two different contact geometries, which may increase a cost, complexity, and/or difficultly of manufacturing, supplying, and/or the like of both vertical and side-entry power connectors.

BRIEF DESCRIPTION OF THE INVENTION

In one embodiment, an electrical connector is provided for mating with a mating connector having a mating contact. The electrical connector includes a housing having a receptacle that is configured to receive the mating contact therein from an insertion direction. An electrical contact is held within the receptacle of the housing. The electrical contact includes opposing arms and a contact finger that extends from one of the arms to the other arm. The contact finger includes a mating interface configured to engage the mating contact when the mating contact is received within the receptacle to electrically connect the electrical contact to the mating contact. The contact finger includes a segment having a length that extends at an angle relative to the insertion direction. The segment includes at least a portion of the mating interface. The electrical contact is configured to electrically connect to the mating contact when the mating contact is inserted into the receptacle of the housing in the insertion direction.

In another embodiment, an electrical connector includes an electrical contact having a mounting segment and opposing arms that extend outwardly from the mounting segment. The mounting segment is configured to be mounted to an electrical device. The electrical contact has a contact finger that extends from one of the arms to the other arm of the electrical contact. The contact finger includes a mating interface configured to engage a mating contact of a mating connector to electrically connect the electrical contact to the mating contact. The contact finger extends along a chevron-shaped path between the arms.

In another embodiment, a kit is provided for assembling an electrical connector that is configured to mate with a mating connector having a mating contact. The kit includes a first housing having a first mounting side. The first housing has a first receptacle that is configured to receive the mating contact therein from a first insertion direction that is angled relative to the first mounting side. The kit also includes a second housing having a second mounting side. The second housing has a second receptacle that is configured to receive the mating contact therein from a second insertion direction that is angled relative to the first insertion direction. An electrical contact is configured to be selectively held within either the first receptacle of the first housing or the second receptacle of the second housing. The electrical contact includes opposing arms and a contact finger that extends from one of the arms to the other arm. The contact finger includes a mating interface configured to engage the mating contact when the electrical contact is held by the first housing and the mating contact is received within the first receptacle. The mating interface is configured to engage the mating contact when the electrical contact is held by the second housing and the mating contact is received within the second receptacle. The contact finger includes a segment having a length that is configured to extend at an angle relative to the first insertion direction when the electrical contact is held by the first housing. The length of the segment is configured to extend at an angle relative to the second insertion direction when the electrical contact is held by the second housing. The segment includes at least a portion of the mating interface. The electrical contact is configured to electrically connect to the mating contact when the electrical contact is held by the first housing and the mating contact is inserted into the first receptacle in first insertion direction. The electrical contact is configured to electrically connect to the mating contact when the electrical contact is held by the second housing and the mating contact is inserted into the second receptacle in second insertion direction.

DETAILED DESCRIPTION OF THE INVENTION

Figure 1:
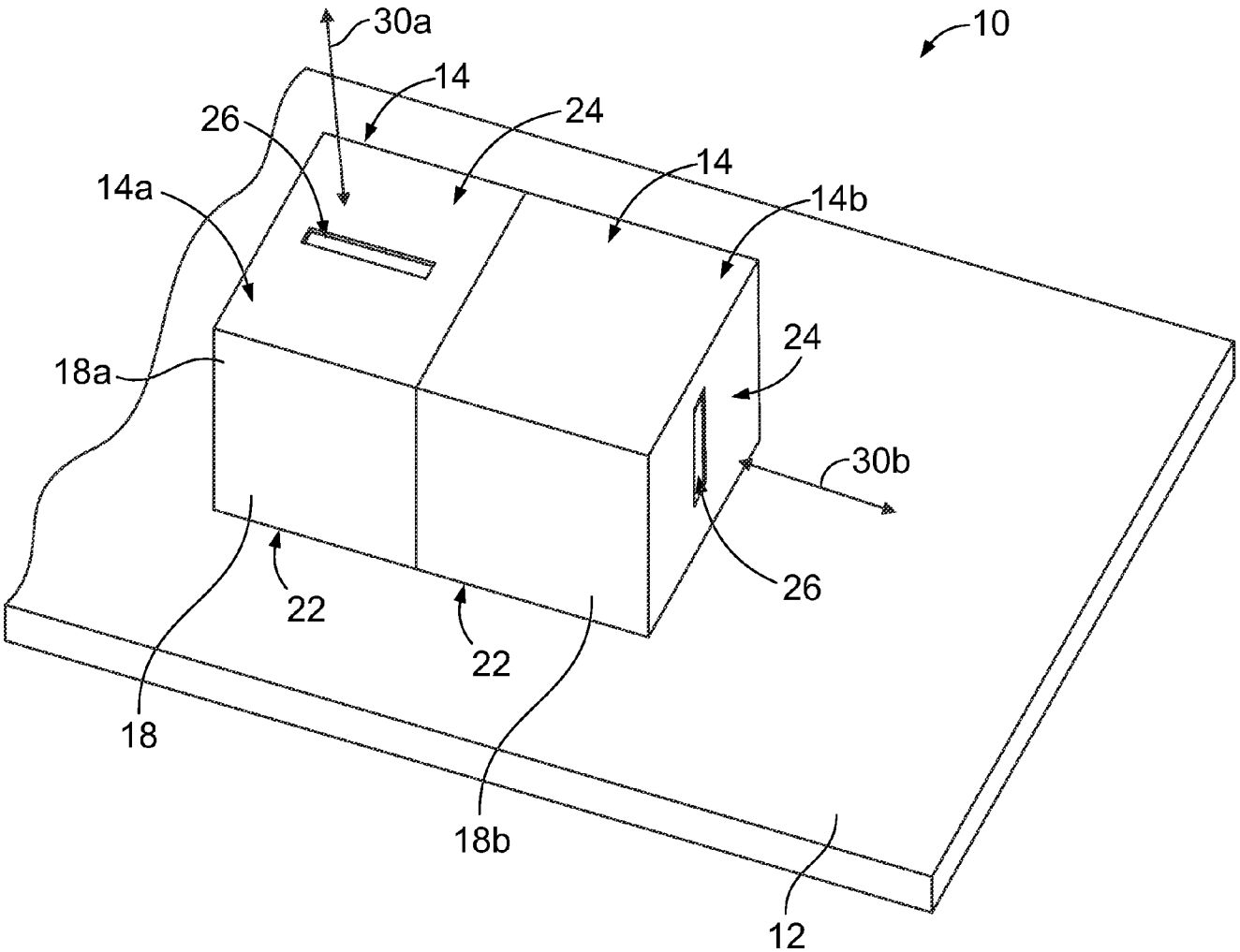
FIG. 1 is a perspective view of an exemplary embodiment of an electrical power connection system.

FIG. 1 is a perspective view of an exemplary embodiment of an electrical power connection system 10. The system 10 includes a circuit board 12 and a plurality of power modules 14 mounted to the circuit board 12. The power modules 14 may be used to provide an electrical power connection between the circuit board 12 and any other electrical device. Exemplary applications for the power modules 14 include, but are not limited to, circuit board-to-circuit board power interconnections, uninterruptible power supply (UPS) systems, battery packs, power distribution for telecommunications, servers, and/or mini-computers, and/or the like. Each of the power modules 14 may be referred to herein as an "electrical connector".

Figure 4:
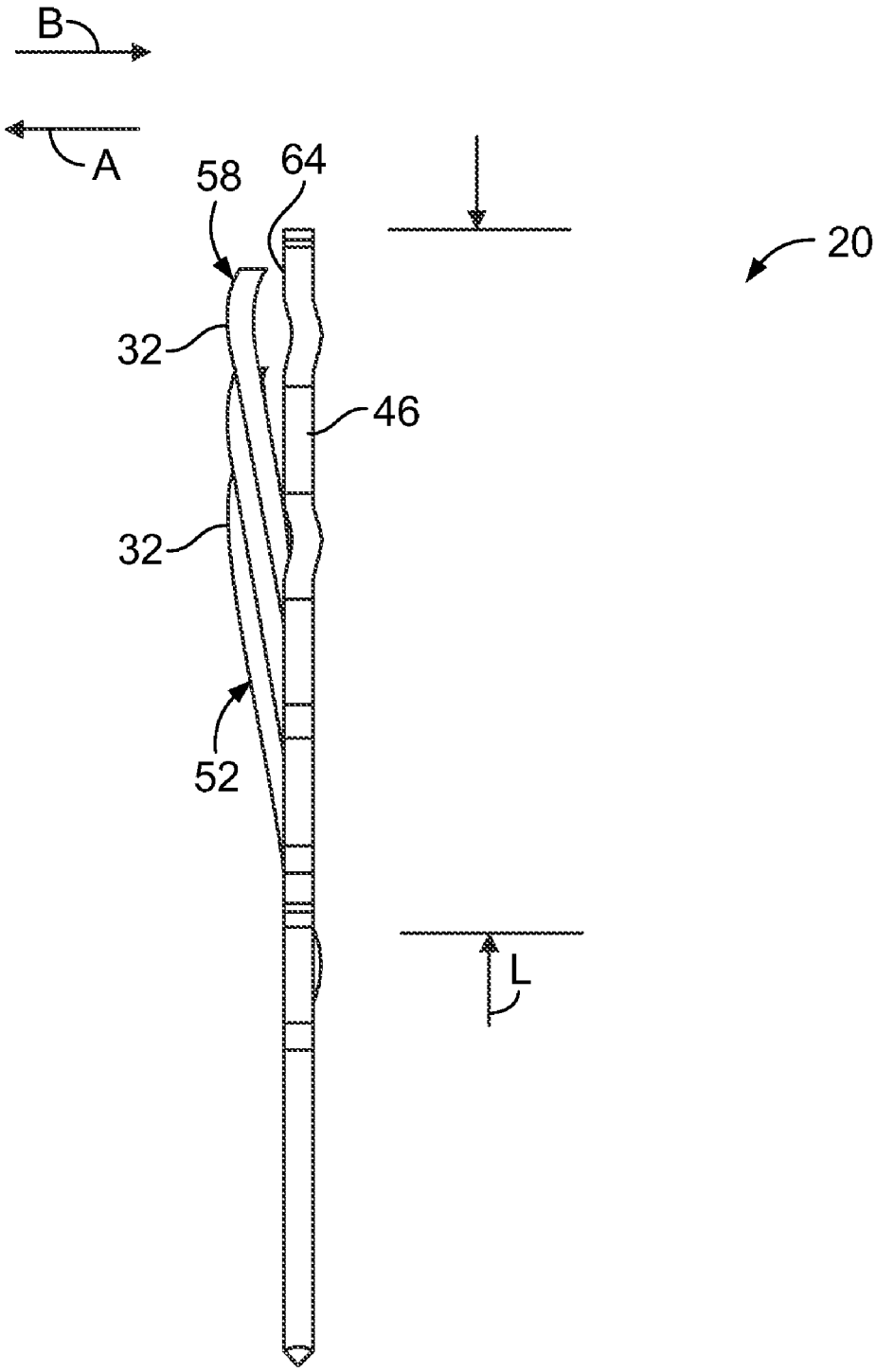
FIG. 4 is a side elevational view of the power contact shown in FIGS. 2 and 3.
Figures 5A, 5B:
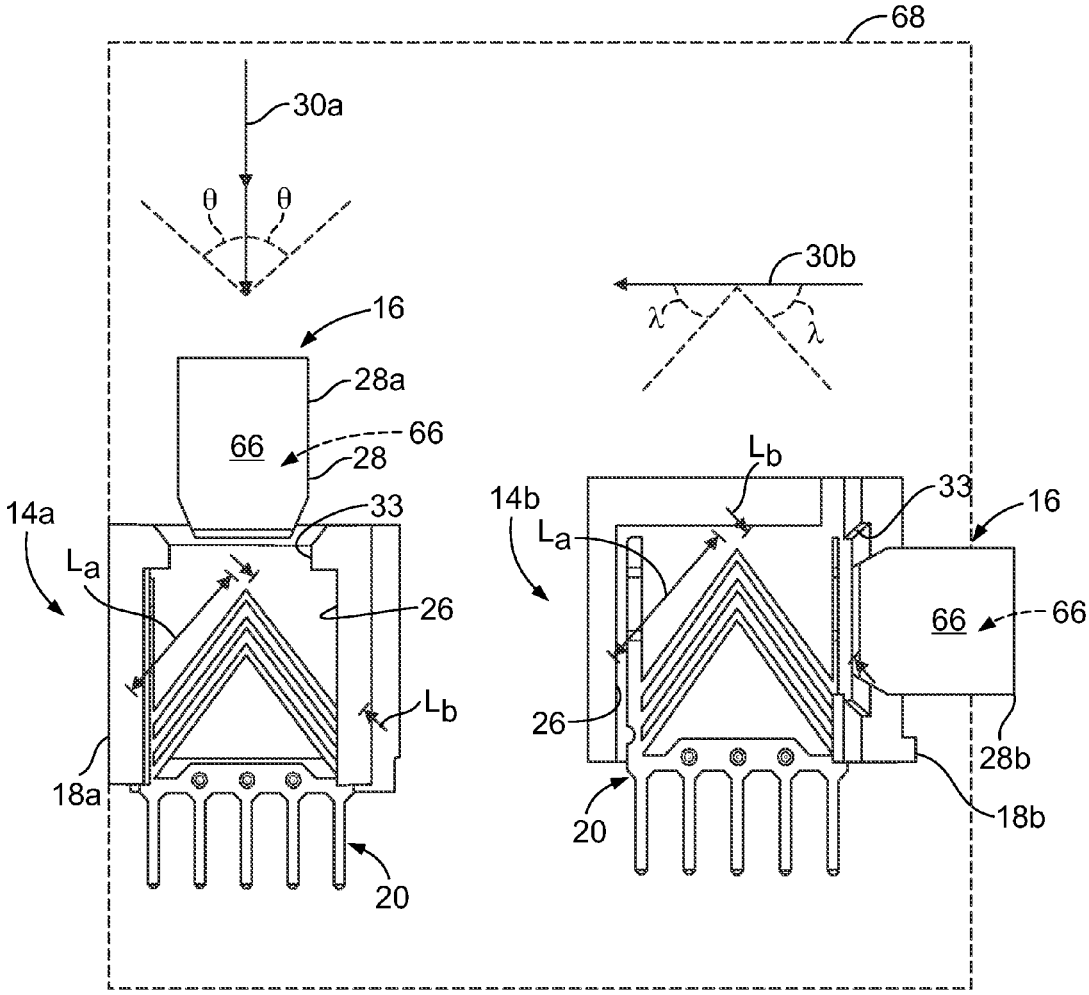
FIGS. 5*a* and 5*b* are cross-sectional views of an exemplary embodiment of power modules of the electrical power connection system shown in FIG. 1.

The power modules 14 are configured to mate with one or more corresponding mating connectors 16 (FIGS. 5*a* and 5*b*). Each power module 14 includes a housing 18 and a pair of electrical power contacts 20 (FIGS. 2-5*a* and 5*b*) held by the housing 18. The housing 18 includes a mounting side 22 and a mating side 24. The housing 18 is mounted to the circuit board 12 along the mounting side 22. Each power module 14 is configured to mate with the corresponding mating connector 16 along the mating side 24 thereof. The housing 18 of each power module 14 includes a receptacle 26 within which the power contacts 20 are held. The receptacle 26 is receives a mating contact 28 (FIGS. 5*a* and 5*b*) of the corresponding mating connector 16 therein when the power module 14 is mated with the mating connector 16.

The housings 18 of the power modules 14 shown in FIG. 1 are configured to receive the corresponding mating contacts 28 therein from different insertion directions 30. For example, the housing 18*a* of the power module 14*a* is configured to receive the corresponding mating contact 28 therein from an insertion direction 30*a*. The housing 18*b* of the power module 14*b* is configured to receive the corresponding mating contact 28 therein from an insertion direction 30*b* that is different than the insertion direction 30*a*. In an exemplary embodiment, the insertion direction 30*a* is approximately perpendicular to the insertion direction 30*b*. But, the insertion directions 30*a* and 30*b* may extend at any other angle besides 0° relative to each other (considered within a common plane, e.g., the plane 68 shown in FIGS. 5*a* and 5*b*, that both insertion directions 30*a* and 30*b* lie within). Each of the housings 18*a* and 18*b* may be referred to herein as a "first" housing and/or a "second" housing. The receptacle 26 of each housing 18*a* and 18*b* may be referred to herein as a "first" and/or a "second" receptacle.

In an exemplary embodiment, the insertion direction 30*a* extends approximately perpendicular to the circuit board 12, while the insertion direction 30*b* extends approximately parallel to the circuit board 12. The insertion direction 30*a* is commonly referred to as a "vertical" insertion direction, and the insertion direction 30*b* is commonly referred to as a "side-entry" insertion direction. Each of the insertion directions 30*a* and 30*b* may be referred to herein as a "first" insertion direction and/or a "second" insertion direction.

The insertion direction 30*a* extends approximately perpendicular to the mounting side 22 of the corresponding housing 18*a*. The mating side 24 of the housing 18*a* extends approximately parallel to the mounting side 22. The insertion direction 30*b* extends approximately parallel to the mounting side 22 of the corresponding housing 18*b*, while the mating side 24 of the housing 18*b* extends approximately perpendicular to the mounting side 22. The receptacles 26 of the housing 18*a* and 18*h* extend through the mating sides 24 thereof at entrances 33 (FIGS. 5*a* and 5*b*) to enable reception of the corresponding mating contact 28 therein. The mounting side 22 of each housing 18*a* and 18*b* may be referred to herein as a "first" and/or a "second" mounting side.

Each power contact 20 has a mating interface 32 (FIGS. 2-4) at which the power contact 20 is configured to engage the mating contact 28 of the corresponding mating connector 16 to establish an electrical connection therebetween. The power contacts 20 are positioned within the receptacle 26 such that the power contacts 20, and specifically the mating interfaces 32, oppose each other. The opposing power contacts 20 engage the mating contact 28 therebetween at the mating interfaces 32. In an exemplary embodiment, the power contacts 20 are configured to mate with a mating contact 28 having a blade, or generally flat, structure, which is commonly referred to as a "blade contact" and/or a "blade".

In an exemplary embodiment, each power module 14 provides a single electrical connection to the circuit board 12. In other words, each power module 14 mates with only a single mating contact 28. However, each power module 14 may provide any other number of electrical connections to the circuit board 12. For example, in some embodiments, each power module 14 mates with two mating contacts 28, at the two power contacts 20, such that each power module 14 provides two electrical connections to the circuit board 12. Although two are shown, the system 10 may include any number of power modules 14 mounted to the circuit board 12. Moreover, any number of the power modules 14 may receive the corresponding mating contact 28 along the insertion direction 30*a*, and any number of the power modules 14 may receive the corresponding mating contact 28 along the insertion direction 30*b*.

Figure 2:
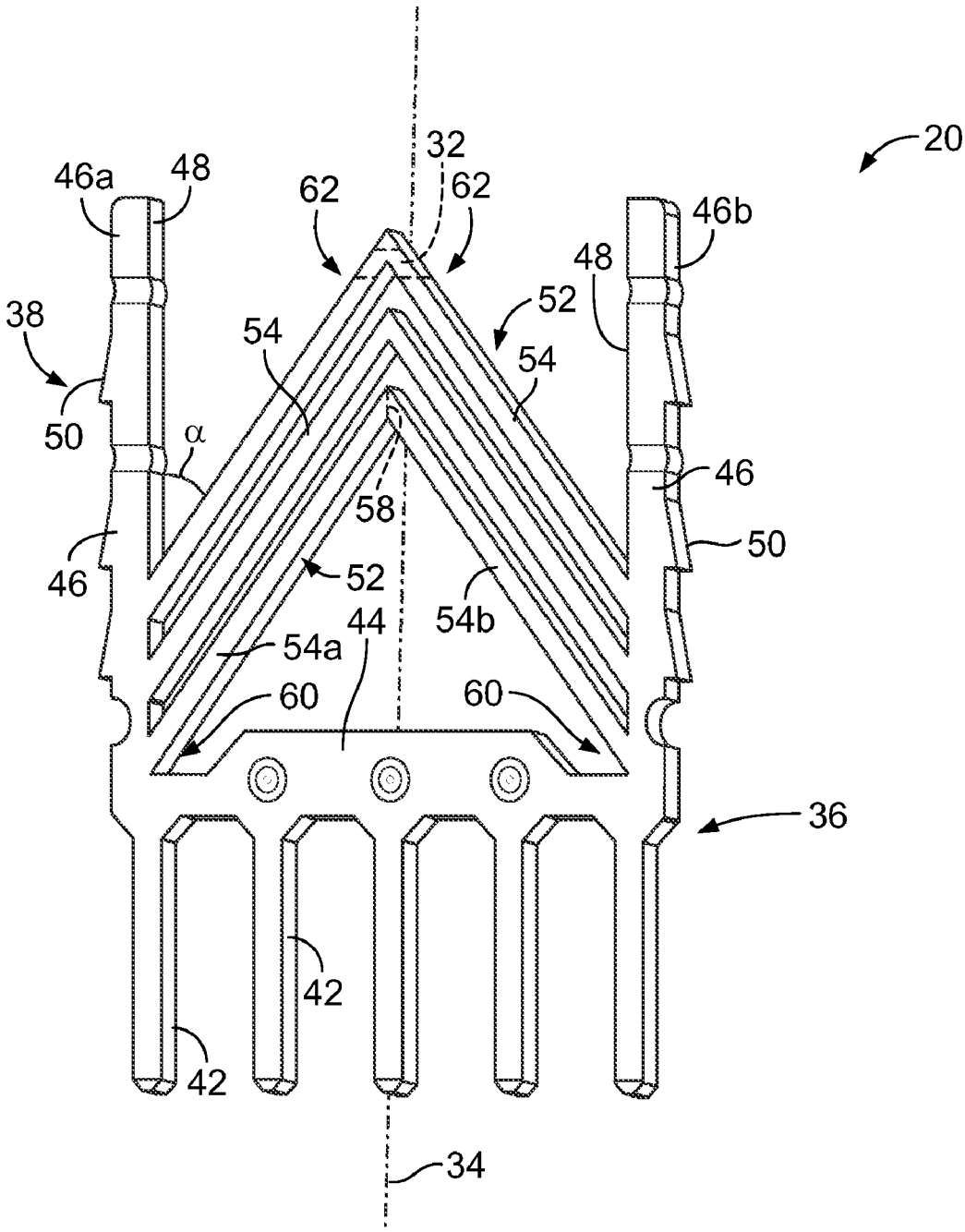
FIG. 2 is a perspective view of an exemplary embodiment of an electrical power contact for use with the system shown in FIG. 1.
Figure 3:
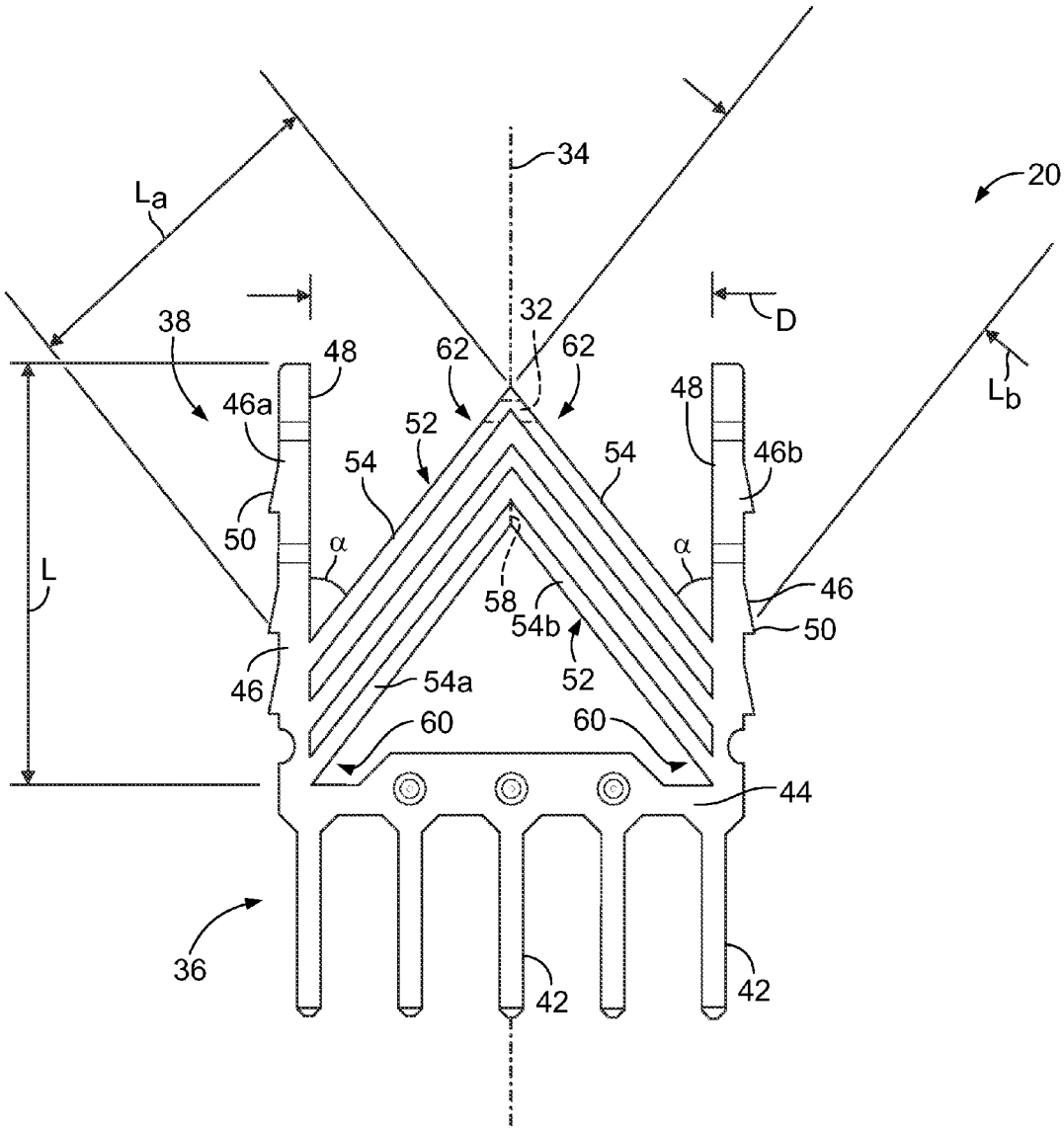
FIG. 3 is a front elevational view of the power contact shown in FIG. 2.

FIG. 2 is a perspective view of an exemplary embodiment of an electrical power contact 20. FIG. 3 is a front elevational view of the power contact 20. The power contact 20 extends along a central axis 34 from a mounting segment 36 to a mating segment 38. The mounting segment 36 is configured to be mounted to an electrical device, such as, but not limited to, the circuit board 12 (FIG. 1). The mounting segment 36 includes a plurality of mounting sub-contacts 42 that are electrically and mechanically connected together by a common bus 44. In an exemplary embodiment, the mounting sub-contacts 42 are solder tails that extend outwardly from the bus 44 for reception within corresponding electrical vias (not shown) of the circuit board 12 (FIG. 1). But, the mounting sub-contacts 42 may alternatively include any other type of structure for mounting to the circuit board 12, such as, but not limited to, a press-fit pin or other press-fit structure, a surface mount structure, and/or the like. Moreover, the mounting segment 36 is not limited to being mounted to a circuit board, but rather may be mounted to any type of electrical device, such as, but not limited to, an electrical conductor (not shown) of an electrical cable (not shown), an electrical wire (not shown), and/or the like.

The mating segment 38 includes opposing arms 46 that extend outwardly from the mounting segment 36. More specifically, the arms 46 extend lengths L (FIGS. 3 and 4) outwardly from the bus 44 of the mounting segment 36. The arms 46 are spaced apart by a distance D (FIG. 3) defined between surfaces 48 of the arms 46 that face each other. The arms 46 include optional barbs 50 that engage interior walls of the housing 18 (FIGS. 1, 5*a*, and 5*b*) for holding the power contact 20 within the receptacle 26 (FIGS. 1, 5*a*, and 5*b*) of the housing 18. In addition or alternative to the barbs 50, the power contact 20 may include any other structure for holding the power contact 20 within the receptacle 26.

Contact fingers 52 extend between, and interconnect, the arms 46. The contact fingers 52 extend from the surface 48 of one of the arms 46*a* to the surface 48 of the other arm 46*b*. In an exemplary embodiment, one or more of the contact fingers 52 includes a chevron shape and extends along a chevron-shaped path between the arms 46*a* and 46*b*. The path of one or more of the contact fingers 52 includes a bend (which may have any angle) in the exemplary embodiment. The contact fingers 52 are spaced apart from one another along the lengths L of the arms 46. Optionally, the contact fingers 52 are nested with adjacent contact fingers 52, for example as shown herein. Although three contact fingers 52 are shown, the power contact 20 may include any number of the contact fingers 52, including only a single contact finger 52.

In an exemplary embodiment, each contact finger 52 includes segments 54 that join together at a tip 58 of the contact finger 52. The tip 58 is indicated by a phantom line in FIGS. 2 and 3. The segment 54*a* extends from the arm 46*a* to the tip 58, and the segment 54*b* extends from the tip 58 to the arm 46*b*, and vice versa. Each segment 54*a* and 54*b* extends a length $L_a$ and $L_b$ (FIG. 3), respectively, defined from the surface 48 of the respective arm 46*a* and 46*b* to the tip 58. The segments 54*a* and 54*b* include ends 60 that extend from the respective arm 46*a* and 46*b* and opposite ends 62 that meet together to define the tip 58. The ends 60 may also be referred to as opposite ends 60 of a contact finger 52.

The lengths $L_a$ and $L_b$ of the segments 54*a* and 54*b*, respectively, extend at oblique angles $\alpha$ relative to the lengths L of the arms 46. In an exemplary embodiment, the lengths $L_a$ and $L_b$ of each of the segments 54*a* and 54*b* extend at angle $\alpha$ of between approximately 30° and approximately 45°. But, the length $L_a$ and $L_b$ of each segment 54*a* and 54*b* may be angled relative to the lengths L of the arms 46 at an oblique angle $\alpha$ having any value. Optionally, the length $L_a$ and/or $L_b$ of the segment 54*a* and/or 54*b*, respectively, extends along an approximately linear path from the respective arm 46*a* and/or 46*b* to the end 62 (and to the tip 58).

In an exemplary embodiment, the tip 58 of a contact finger 52 is an intermediate point that is located between the ends 60 of the contact finger 52. The tip 58 is offset from the ends 60 along the lengths L of the arms 46. The offset may have any value. Although in an exemplary embodiment the contact fingers 52 include a chevron shape, each contact finger 52 may include any other shape. In an exemplary embodiment, the lengths $L_a$ and/or $L_b$ of the segments 54*a* and 54*b*, respectively, of a contact finger 52 are approximately equal, and the angles $\alpha$ of the segments 54*a* and 54*b* relative to the arms 46 are approximately equal. Accordingly, the tip 58 of the contact finger 52 is a midpoint along the path of the contact finger 52 in an exemplary embodiment. Alternatively, the lengths $L_a$ and/or $L_b$ and/or the angles $\alpha$ of the segments 54*a* and 54*b* of a contact finger are different, such that the tip 58 does not define a midpoint along the path of the contact finger 52.

Each contact finger 52 includes at least a portion of the mating interface 32 of the power contact 20. For example, when the power contact 20 includes only a single contact finger 52, the contact finger 52 includes the entire mating interface 32 of the power contact 20. When the power contact 20 includes a plurality of the contact fingers 52, each contact finger 52 includes a portion of the mating interface 32 of the power contact 20. Each contact finger 52 may therefore be considered to including a mating interface 32. As can be seen in FIGS. 2 and 3, the ends 62 of each of the segments 54*a* and 54*b* of a contact finger 52 include a portion of the mating interface 32 of the contact finger 52. Moreover, the mating interface 32 of a contact finger 52 includes the tip 58 of the contact finger 52. The mating interfaces 32 are shown in phantom lines in FIGS. 2 and 3.

FIG. 4 is a side elevational view of the power contact 20. As can be seen in FIG. 4, the contact fingers 52 of the power contact 20 are angled relative to the lengths L of the arms 46 in a direction indicated by the arrow A. The tips 58 of the contact fingers 52 are offset from a side 64 of the arms 46. The side 64 of the arms 46 faces generally toward the opposing power contact 20 when the power contact 20 is held within the receptacle 26 (FIGS. 1 and 5). The tips 58 of the contact fingers 52 are offset from the side 64 generally toward the opposing power contact 20 when the power contact 20 is held within the receptacle 26. The mating interfaces 32 of the contact fingers 52 are offset from the side 64 in a direction generally toward the opposing power contact 20 when the power contact 20 is held within the receptacle 26. The contact fingers 52 are springs that are configured to deflect in the direction of the arrow B when engaged with the mating contact 28 (FIGS. 5*a* and 5*b*). The tips 58 and the mating interfaces 32 may be offset from the side 64 by any amount, which may be selected to provide a predetermined engagement force between the mating interfaces 32 and the mating contact 28.

Referring again to FIG. 1, the power contact 20 (FIGS. 2-5*a* and 5*b*) can be used with either of the power modules 14*a* or 14*b*. More specifically, the power contact 20 can be used with a power module 14*a* that is configured to receive the corresponding mating contact 28 therein from the insertion direction 30*a*. The same power contact 20 can also be used with a power module 14*b* that is configured to receive the corresponding mating contact 28 therein from the insertion direction 30*b*. FIGS. 5*a* and 5*b* are cross-sectional views of the power modules 14*a* and 14*b* illustrating use of the same power contact 20 with each module 14*a* and 14*b*. FIG. 5*a* illustrates the power module 14*a*, which includes the housing 18*a*. The power contact 20 shown in FIGS. 2-4 is held within the receptacle 26 of the housing 18*a*. The mating contact 28 is also illustrated in FIG. 5*a*. The corresponding mating contact 28*a* is configured to be received into the receptacle 26, through the entrance 33, from the insertion direction 30*a*. As can be seen in FIG. 5*a*, the mating contact 28 is a blade contact that includes opposite approximately flat sides 66, one of which engages the mating interface 32 of the power contact 20 when received within the receptacle 26 of the housing 18*a*.

FIG. 5*b* illustrates the power module 14*b*. The power contact 20 shown in FIGS. 2-4 is held within the receptacle 26 of the housing 18*b* of the power module 14*b*. The corresponding mating contact 28*b* is configured to be received into the receptacle 26 of the housing 18*b* from the insertion direction 30*b*. The mating contact 28*b* is a blade contact that includes opposite approximately flat sides 66, one of which engages the mating interface 32 of the power contact 20 when received within the receptacle 26 of the housing 18*b*.

As described above, and referring to FIGS. 5*a* and 5*b*, the same power contact 20 is configured to be used with both a power module 14*a* that receives the corresponding mating contact 28*a* from the insertion direction 30*a* and a power module 14*b* that receives the corresponding mating contact 28*b* from the insertion direction 30*b*. In other words, the same power contact 20 is interchangeable between the housings 18*a* and 18*b*. The mating interface 32 of the power contact 20 is configured to make a reliable electrical connection to the side 66 of the mating contact 28 when the mating contact 28 is inserted into the receptacle 26 in either of the insertion directions 30*a* or 30*b*.

The insertion directions 30*a* and 30*b* lie within a common plane 68. Referring now to the power module 14*a* shown in FIG. 5*a*, when the power contact 20 is held by the housing 18*b*, the length $L_a$ and $L_b$ of each of the segments 54*a* and 54*b*, respectively, of the contact fingers 52 extends at an angle $\theta$ relative to the insertion direction 30*a*. The length $L_a$ and $L_b$ of each of the segments 54*a* and 54*b*, respectively, extends along the plane 68 in a direction that is angled (at angle $\theta$) within the plane 68 relative to the insertion direction 30*a*. As should be apparent from FIGS. 5*a* and 5*b*, the length $L_a$ and $L_b$ of each of the segments 54*a* and 54*b*, respectively, also extends at an angle γ relative to the insertion direction 30*b*. Moreover, the length $L_a$ and $L_b$ of each of the segments 54*a* and 54*b*, respectively, extends along the plane 68 in a direction that is angled (at angle γ) within the plane 68 relative to the insertion direction 30*b*. When the corresponding mating contact 28*a* is received within the receptacle 26 of the housing 18*a* from the insertion direction 30*a*, the mating interface 32 of the power contact 20 is configured to make a reliable electrical connection to the side 66 of the mating contact 28*a*.

As should be apparent from FIGS. 5*a* and 5*b*, the power contact 20 is held in the receptacle 26 of each housing 18*a* and 18*b* in the same orientation relative to the mounting side 22 of the respective housing 18*a* and 18*b*. Referring now to the power module 14*b*, as the mating contact 28*b* is inserted into the receptacle 26 of the housing 18*b*, the side 66 of the mating contact 28*b* rides along the segment 54*b* toward the tip 58. When the power contact 20 is held by the housing 18*b*, the length $L_a$ and $L_b$ of each of the segments 54*a* and 54*b*, respectively, of the contact fingers 52 extends at the angle γ relative to the insertion direction 30*b*. The length $L_a$ and $L_b$ of each of the segments 54*a* and 54*b*, respectively, extends along the plane 68 in a direction that is angled (at the angle γ) within the plane 68 relative to the insertion direction 30*b*. When held by the housing 18*b*, the length $L_a$ and $L_b$ of each of the segments 54*a* and 54*b*, respectively, also extends at an angle θ relative to the insertion direction 30*a*. When the corresponding mating contact 28*b* is received within the receptacle 26 of the housing 18*b* from the insertion direction 30*b*, the mating interface 32 of the power contact 20 is configured to make a reliable electrical connection to the side 66 of the mating contact 28*a*.

Each of the angles γ and θ of the length $L_a$ and $L_b$ of each of the segments 54*a* and 54*b*, respectively, relative to the insertion directions 30*b* and 30*a*, respectively, may be selected as an angle having any value, such as, but not limited to, between approximately 20° and approximately 70°. In some embodiments, an angle γ and/or 0 is selected based on the insertion direction 30*a* and/or 30*b* and/or to facilitate a reliable electrical connection between the contacts 20 and 28*a* at the mating interface 32.

In some embodiments, a kit may be provided for assembling a power module 14. The kit includes a housing 18*a*, the housing 18*b*, and a power contact 20. As described above, the power contact 20 is interchangeable between the housings 18*a* and 18*b*. Accordingly, the power contact 20 is configured to be selectively held within either the receptacle 26 of the housing 18*a* or the receptacle 26 of the housing 18*b*. The kit thus provides the ability to assembly a power module 14 that receives the mating contact 28 from either of two different insertion directions.

Figure 6:
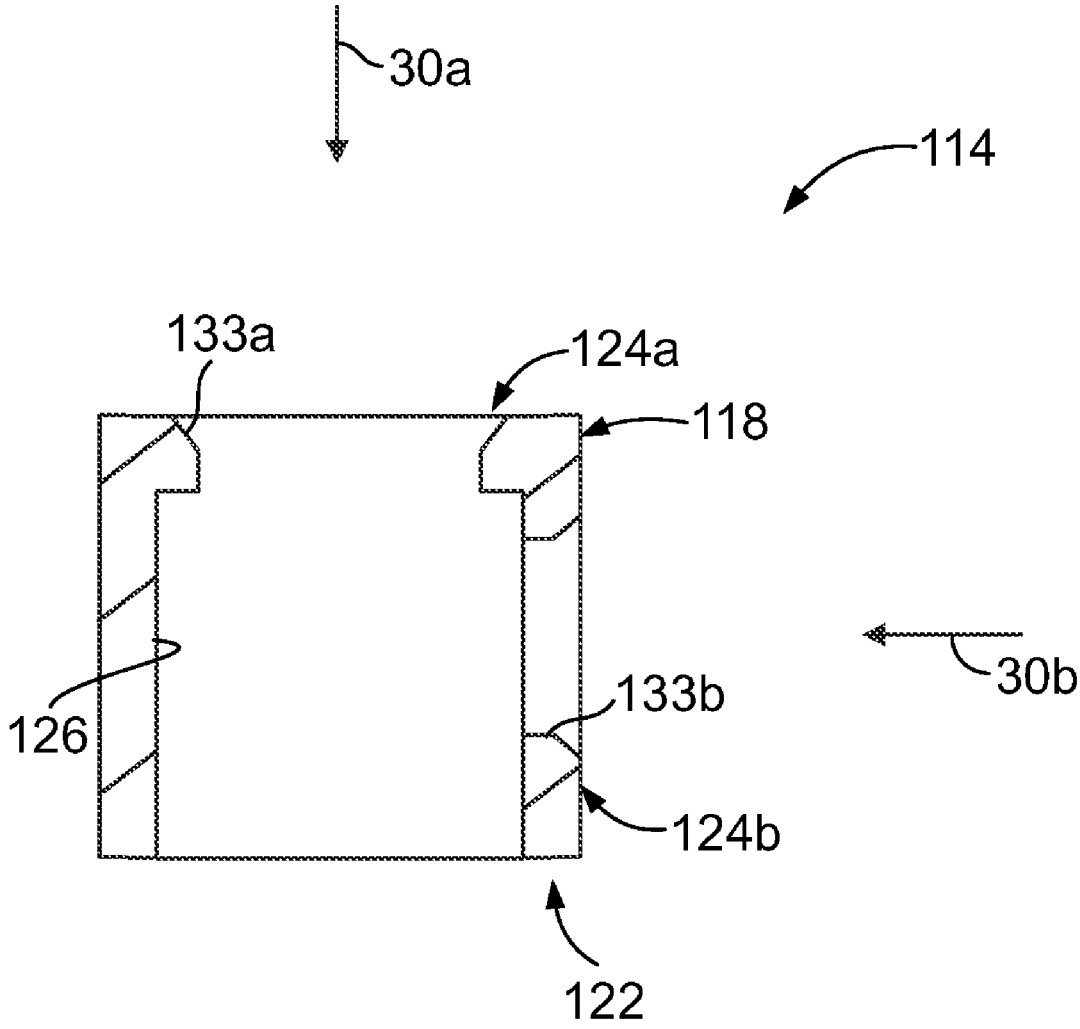
FIG. 6 is a cross-sectional view of an exemplary alternative embodiment of a housing of a power module of the electrical power connection system shown in FIG. 1.

FIG. 6 is a cross-sectional view of an exemplary alternative embodiment of a housing 118 of a power module 114 that may used with the system 10 (FIG. 1). The power module 114 includes a housing 118 and a pair of electrical power contacts 20 (FIGS. 2-5) held by the housing 118. The housing 118 includes a mounting side 122 and two mating sides 124*a* and 124*b*. The housing 118 includes a receptacle 126 that receives a mating contact 28 (FIGS. 5*a* and 5*b*) of the corresponding mating connector 16 (FIGS. 5*a* and 5*b*) therein. The housing 118 is configured to receive the corresponding mating contact 28 therein from either of two different insertion directions, for example both of the insertion directions 30*a* and 30*b*. The housing 118 includes two entrances 133*a* and 133*b* to the receptacle 126 to enable the housing 118 to receive the mating contact 28 from either of the insertion directions 30*a* and 30*b*. The entrance 133*a* extends within the mating side 124*a*, which extends approximately parallel to the mounting side 122, for receiving the mating contact 28*a* from the insertion direction 30*a*. The entrance 133*b* extends within the mating side 124*b*, which extends approximately perpendicular to the mounting side 122, for receiving the mating contact 28*b* from the insertion direction 30*b*.

The housing 118 may be referred to herein as a "first" housing and/or a "second" housing. The receptacle 126 may be referred to herein as a "first" and/or a "second" receptacle. The mounting side 122 of the housing 118 may be referred to herein as a "first" and/or a "second" mounting side.

The embodiments described and/or illustrated herein may provide an electrical power contact that is interchangeable between housings that receive a mating contact from different insertion directions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, directions of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for mating with a mating connector having a mating contact, the electrical connector comprising:

a housing comprising a receptacle that is configured to receive the mating contact therein from an insertion direction;

an electrical contact held within the receptacle of the housing, the electrical contact comprising opposing arms and a contact finger that extends from one of the arms to the other arm, the contact finger comprising a mating interface configured to engage the mating contact when the mating contact is received within the receptacle to electrically connect the electrical contact to the mating contact, wherein the contact finger comprises a segment having a length that extends at an angle relative to the insertion direction, the segment comprising at least a portion of the mating interface, the electrical contact being configured to electrically connect to the mating contact when the mating contact is inserted into the receptacle of the housing in the insertion direction.

2. The electrical connector of claim 1, wherein the segment of the contact finger is a first segment, the contact finger further comprising a second segment, the first segment extending from one of the arms of the electrical contact to a tip of the contact finger, the second segment extending from the tip of the contact finger to the other arm of the electrical contact, wherein the second segment has a length defined from the corresponding arm to the tip of the contact finger, the length of the second segment extending at an angle relative to the insertion direction.

3. The electrical connector of claim 1, wherein the length of the segment of the contact finger extends at an angle relative to the insertion direction of between approximately 20° and approximately 70°.

4. The electrical connector of claim 1, wherein the contact finger comprises a chevron shape.

5. The electrical connector of claim 1, wherein the electrical contact comprises a plurality of the contact fingers, the contact fingers being nested with adjacent contact fingers.

6. The electrical connector of claim 1, wherein the length of the segment extends along an approximately linear path from one of the arms to an end that includes at least a portion of the mating interface.

7. The electrical connector of claim 1, wherein the arms of the electrical contact extend lengths, the contact finger extending from the arms at corresponding ends of the contact finger, the contact finger comprising an intermediate point that is located between the ends of the contact finger and that is offset from at least one of the ends along the lengths of the arms, the mating interface of the contact finger comprising the intermediate point.

8. The electrical connector of claim 1, wherein the insertion direction is a first insertion direction, the receptacle of the housing being configured to receive the mating contact therein from at least one of the first insertion direction or a second insertion direction that extends approximately perpendicular to the first insertion direction, the length of the segment extending at an angle relative to both the first and second insertion directions, the electrical contact being configured to electrically connect to the mating contact when the mating contact is inserted into the receptacle of the housing in either of the first and second insertion directions.

9. The electrical connector of claim 8, wherein the first and second insertion directions lie within a common plane, the length of the segment extending along the plane in a direction that is angled within the plane relative to the both the first and second insertion directions.

10. An electrical connector comprising:

an electrical contact having a mounting segment and opposing arms that extend outwardly from the mounting segment, the mounting segment being configured to be mounted to an electrical device, the electrical contact having a contact finger that extends from one of the arms to the other arm of the electrical contact such that the contact finger is connected to the other arm, the contact finger comprising a mating interface configured to engage a mating contact of a mating connector to electrically connect the electrical contact to the mating contact, the contact finger extends along a chevron-shaped path between the arms.

11. The electrical connector of claim 10, wherein the contact finger comprises a first segment that extends from one of the arms of the electrical contact to a tip of the contact finger, and a second segment that extends from the tip of the contact finger to the other arm of the electrical contact, wherein the first and second segments are angled obliquely relative to the arms.

12. The electrical connector of claim 10, wherein the mounting segment comprises a plurality of mounting contacts and a bus, the mounting contacts being configured to be electrically connected to the electrical device and being electrically and mechanically connected together by the bus, the arms extending outwardly from the bus.

13. The electrical connector of claim 10, wherein the arms of the electrical contact extend lengths, the contact finger extending from the arms at corresponding ends of the contact finger, the contact finger comprising an intermediate point that is located between the ends of the contact finger and that is offset from at least one of the ends along the lengths of the arms, the mating interface of the contact finger comprising the intermediate point.

14. An electrical connector comprising:

an electrical contact having a mounting segment and opposing arms that extend outwardly from the mounting segment being configured to be mounted to an electrical device, the electrical contact having a contact finger that extends from one of the arms to the other arm of the electrical contact, the contact finger comprising a mating interface configured to engage a mating contact of a mating connector to electrically connect the electrical contact to the mating contact, the contact finger extends along a chevron-shaped path between the arms, wherein the electrical contact comprises a plurality of the contact fingers, the contact fingers being nested within adjacent contact fingers.

15. A kit for assembling an electrical connector that is configured to mate with a mating connector having a mating contact, the kit comprising:

a first housing comprising a first mounting side, the first housing having a first receptacle that is configured to receive the mating contact therein from a first insertion direction that is angled relative to the first mounting side;

a second housing comprising a second mounting side, the second housing having a second receptacle that is configured to receive the mating contact therein from a second insertion direction that is angled relative to the first insertion direction; and an electrical contact configured to be selectively held within either the first receptacle of the first housing or the second receptacle of the second housing, the electrical contact comprising opposing arms and a contact finger that extends from one of the arms to the other arm, the contact finger comprising a mating interface configured to engage the mating contact when the electrical contact is held by the first housing and the mating contact is received within the first receptacle, the mating interface being configured to engage the mating contact when the electrical contact is held by the second housing and the mating contact is received within the second receptacle, wherein the contact finger comprises a segment having a length that is configured to extend at an angle relative to the first insertion direction when the electrical contact is held by the first housing, the length of the segment being configured to extend at an angle relative to the second insertion direction when the electrical contact is held by the second housing, the segment comprising at least a portion of the mating interface, the electrical contact being configured to electrically connect to the mating contact when the electrical contact is held by the first housing and the mating contact is inserted into the first receptacle in first insertion direction, the electrical contact being configured to electrically connect to the mating contact when the electrical contact is held by the second housing and the mating contact is inserted into the second receptacle in second insertion direction.

16. The kit of claim 15, wherein the first and second insertion directions lie within a common plane, the length of the segment being configured to extend along the plane in a direction that is angled within the plane relative to the first insertion direction when the electrical contact is held by the first housing, the length of the segment being configured to extend along the plane in a direction that is angled within the plane relative to the second insertion direction when the electrical contact is held by the second housing.

17. The kit of claim 15, wherein the segment of the contact finger is a first segment, the contact finger further comprising a second segment, the first segment extending from one of the arms of the electrical contact to a tip of the contact finger, the second segment extending from the tip of the contact finger to the other arm of the electrical contact, wherein the second segment has a length defined from the corresponding arm to the tip of the contact finger, the length of the second segment being configured to extend at an angle relative to the first insertion direction when the electrical contact is held by the first housing, the length of the second segment being configured to extend at an angle relative to the second insertion direction when the electrical contact is held by the second housing.

18. The kit claim 15, wherein the contact finger comprises a chevron shape.

19. The kit of claim 15, wherein the electrical contact comprises a plurality of the contact fingers, the contact fingers being nested within adjacent contact fingers.

20. The kit of claim 15, wherein the first and second insertion directions extend approximately perpendicular to each other.

* * * * *